United States Patent [19]

Renaud

[11] Patent Number: 4,674,296

[45] Date of Patent: Jun. 23, 1987

[54] REFRIGERATION BLOCK

[76] Inventor: Roger Renaud, 124 Beland, Gatineau, Quebec, Canada, J8R 1G3

[21] Appl. No.: 845,313

[22] Filed: Mar. 28, 1986

[30] Foreign Application Priority Data

Mar. 14, 1986 [CA] Canada ..... 504168

[51] Int. Cl.[4] ..... B67D 5/62

[52] U.S. Cl. ..... 62/389; 62/393

[58] Field of Search ..... 222/146.6; 62/389, 393

[56] References Cited

U.S. PATENT DOCUMENTS

| | | | |
|---|---|---|---|
| 1,969,643 | 8/1934 | Fuchs et al. | 62/389 X |
| 3,309,886 | 3/1967 | Welty | 62/389 X |
| 4,502,294 | 3/1985 | Grant | 62/389 |

*Primary Examiner*—Lloyd L. King

*Attorney, Agent, or Firm*—Jones, Tullar & Cooper

[57] ABSTRACT

The specification describes a cooling block adapted to be used with dispensers of beverages such as beer. The block is intended to be installed within a bar tower such that a feed line carrying the beverage from a remote container to the dispenser is contacted thereby. The block is cooled by means of a refrigeration line.

7 Claims, 5 Drawing Figures

PRIOR ART

REFRIGERATION BLOCK

This invention relates to beverage dispensers in which a beverage, such as draft beer, is drawn from a container to a remote spigot. More particularly, the invention relates to a refrigeration block used in conjunction with such a dispenser so as to ensure that the beverage leaving the spigot is chilled.

It is known that when warm draft beer is drawn into a glass, excessive foam is generated. This results in incomplete filling of the glasses, unless considerable time is spent in the process. In active night spots this time is not available. It is further known that foam generation is reduced by cooling the draft beer in the feed line between the spigot and the beer barrel or tank.

Presently, this cooling is effected by a refrigeration line, charged with a suitable refrigeration fluid, placed in proximity or contact with the feed line. Although this method results in improved conditions it is not entirely satisfactory.

Accordingly, this invention overcomes the aforementioned problem by providing a temperature conductive block adapted to partially surround the feed line adjacent to the connection to the spigot. The block also provides a channel or grooves adapted to receive the refrigeration line. In this way the block is cooled by the refrigeration line which in turn cools the spigot and feed lines. Hence, beer or other liquid exiting the spigot has passed through this cooled zone so formed and cooled thereby.

The invention will now be described in greater detail with reference to the accompanying drawings wherein.

Figure 1:
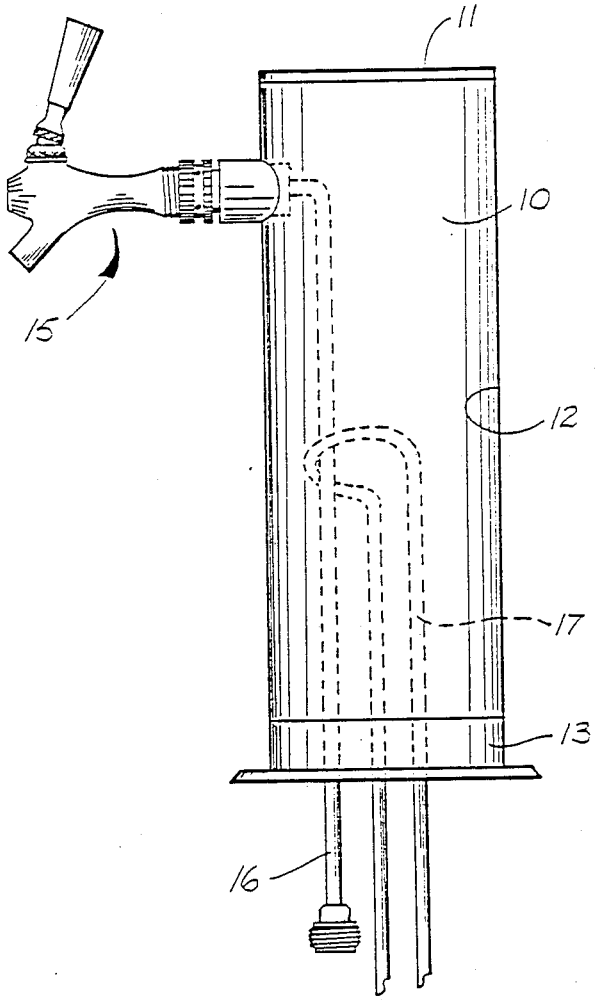
FIG. 1 is a tower with spigot and feed line.

With reference to FIG. 1, a tower of the type which might be found in a bar is illustrated. The tower 10 includes a cover 11 and a hollow chamber 12 which in a preferred arrangment is essentially cylindrical. The base 13 is fastened by suitable means to a bar, table or other convenient support.

Spigot or tap 15 is secured to the tower and is joined to feed line 16 which passes through the chamber 12. The feed line exits through the base of the tower and is connected to a source of beverage such as draft beer (not shown).

Figure 2:
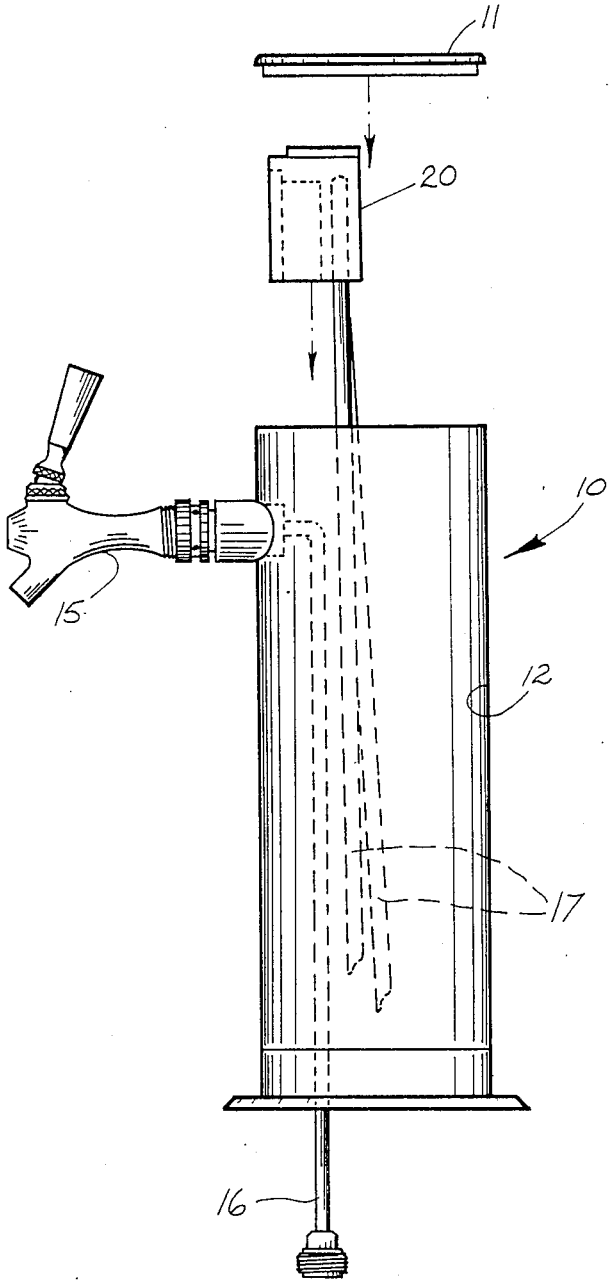
FIG. 2 illustrates a tower with a refrigeration block in place.

In known arrangements, a refrigerated line 17 carrying a refrigeration fluid such as freon is bent around the feed line 16 as shown in FIG. 1 for the purpose of cooling the beverage flowing therethrough. In the arrangement shown in FIG. 1, when the beverage is not being drawn, the residue in the line above the refrigeration line as well as in the spigot warms up. Thus, when the next quantity of beverage is drawn, the initial amount is warm. When the beverage is draft beer, this results in undesirable foam generation. The problem is overcome by the arrangement shown in FIG. 2. In this case in accordance with the present invention, a refrigeration block is joined to the feed line directly at the point of entry to the spigot. Additionally, the block is arranged to contact the refrigerated line, thus cooling the spigot and feed line.

Figure 3:
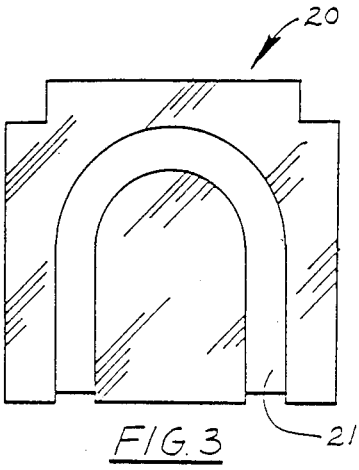
FIG. 3 illustrates the rear view of a block according to the present invention.

As shown in FIG. 3 the rear of the block 20 which is of a temperature conducting material such as aluminum contains a channel or groove 21. The refrigeration line fits snugly within this groove so that efficient cooling of the block is effected. Although the channel in FIG. 3 is shown to be U-shaped, it is to be understood that other configurations could be employed.

Figure 4:
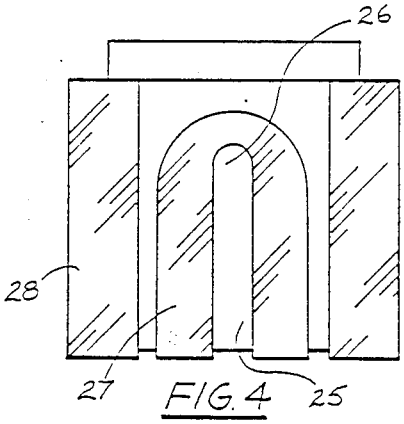
FIG. 4 illustrates the front of the block according to one embodiment.

The front of the block shown in FIG. 4 has a central channel 25 which is adapted to surround the feed line 16. The upper edge 26 of the channel 25 accommodates the upper end of the feed line just prior to exiting the tower to join the spigot. The U-shaped raised portion 27 contacts the rear face of the spigot attachment means, and the raised portions 28 contact the inner wall of the tower.

The block is held in place by any suitable fastening means as for example tape.

In operation, the block is secured to the feed line and spigot, and the refrigeration line is pressed into channel 21. The flowing refrigeration fluid results in cooling of the block 20 which in turn cools the feed line and spigot. Now when the beverage is not being drawn it remains cool in the spigot.

Figure 5:
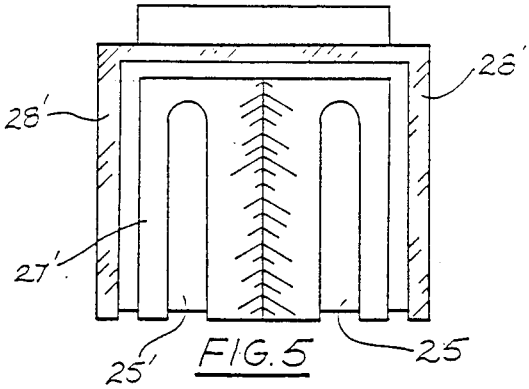
FIG. 5 illustrates the front of a block according to a second embodiment.

The embodiment shown in FIG. 5 is similar to the embodiment of FIG. 4 except that it is intended to be used with a double tower or a tower with two spigots and two feed lines. It is to be understood that refrigeration blocks according to these herein can be constructed to accommodate three or more feed lines and associated spigots or taps.

The aluminum refrigeration block of FIGS. 3–5 may be machined in the desired configuration or cast using suitable molds.

Although the foregoing description has referred particularly to draft beer, it is understood that the refrigeration block can be used with chillable wines or other beverages of the type which are drawn from a container to a remote dispenser.

The embodiments of the invention in which an exclusive property or privilege is claimed are defined as follows:

1. A refrigeration block for use with a beverage dispenser of the type having a spigot, a beverage container remote from the spigot, and a feed line between the spigot and the beverage container to permit beverage to flow from said container to said spigot, the refrigeration block comprising a block of temperature conducting material having a first channel arranged to receive and partially surround said beverage feed line, and a second channel adapted to receive a tube through which a refrigerating fluid is permitted to flow thereby cooling the refrigeration block and hence a beverage in said feed line.

2. A refrigeration block according to claim 1 wherein said temperature conducting material is aluminum.

3. A refrigeration block according to claim 1 wherein said first channel is formed in a first side of said temperature conducting material.

4. A refrigeration block according to claim 1 wherein said second channel is formed in a second side of said temperature conducting material.

5. A refrigeration block according to claim 4 wherein said second channel is U-shaped.

6. A refrigeration block according to claim 1 wherein said first side includes a pair of channels adapted to receive therein a pair of feed lines in a side by side relation.

7. A refrigeration block according to claim 1 wherein said block of temperature conducting material is arranged so as to partially surround said feed line in close proximity to said spigot.

* * * * *